US007810778B1

(12) United States Patent
Chang

(10) Patent No.: US 7,810,778 B1
(45) Date of Patent: Oct. 12, 2010

(54) HEIGHT ADJUSTMENT ASSEMBLY FOR FURNITURE

(76) Inventor: Chien-Kuo Chang, 10-2 No. 447, 3 Sec. Wen-Hsin Rd., Taichung City (TW)

( * ) Notice: Subject to any disclaimer, the term of this patent is extended or adjusted under 35 U.S.C. 154(b) by 0 days.

(21) Appl. No.: 12/485,060

(22) Filed: Jun. 16, 2009

(51) Int. Cl.
*F16M 11/00* (2006.01)

(52) U.S. Cl. ..... 248/410; 248/723

(58) Field of Classification Search ..... 248/423, 248/157, 188.2, 188.5, 410, 161, 411, 125.9; 108/147.21, 146
See application file for complete search history.

(56) References Cited

U.S. PATENT DOCUMENTS

| | | | | |
|---|---|---|---|---|
| 5,752,449 | A * | 5/1998 | Simon et al. | 108/50.02 |
| 2004/0135045 | A1 * | 7/2004 | Larson | 248/188.1 |
| 2010/0024687 | A1 * | 2/2010 | Preiss | 108/50.02 |

* cited by examiner

*Primary Examiner*—Ramon O Ramirez

(57) ABSTRACT

A height adjustment assembly for furniture has a control member automatically engaging a movable member of a piece of furniture by gravity, so as to hold the movable member at a desired height. When operated, the control member releases the movable member so that the height of the furniture can be readjusted and reset.

5 Claims, 6 Drawing Sheets

HEIGHT ADJUSTMENT ASSEMBLY FOR FURNITURE

BACKGROUND OF THE INVENTION

1. Technical Field

The present invention relates to modulized components for adjusting height of furniture, and more particularly, to a height adjustment assembly applicable to furniture.

2. Description of Related Art

Telescoped tubes are conventionally used as the approach to allowing height adjustment of furniture. Taking one known adjustment assembly of a table for example, an outer tube may be fixed to a brace of the table while an inner tube telescoped with the outer tube may be coupled with a tabletop plate, so that when the inner tube shifts inside the outer tube, the altitude of the tabletop plate is changed with respect to the brace. One or more manually operatable screw bolt may be provided on the outer tube to pierce into a hole formed on the inner tube so as to position the inner tube with respect to the outer tube, thereby holding the tabletop plate at the desired height.

However, when using the conventional adjustment approach implementing telescoped tubes and bolts, a user has to repeatedly screw and unscrew the bolts. Especially, when any piece of furniture uses two or more such adjustment assemblies for its two or more legs, each said one has to be adjusted separately. Thus, not only is the operation time-consuming, but also the inconsistent adjustment of the plural adjustment assemblies causes an inclined top surface of the furniture. Hence, there is a need for an improved height adjustment assembly that is convenient and effective to operate.

SUMMARY OF THE INVENTION

In view of the shortcomings of the prior art, one objective of the present invention is to provide a height adjustment assembly for furniture, by using which height adjustment assembly, a height of a piece of furniture being adjustable.

Another objective of the present invention is to provide a height adjustment assembly for furniture, wherein the height adjustment assembly has a control member automatically engaging a movable member of a piece of furniture by gravity, so as to hold the movable member at a desired height. When the control member is pulled upward, the control member of the height adjustment assembly and the movable member of the furniture are disengaged so as to allow the movable member to move vertically along the furniture.

To achieve these and other objectives of the present invention, the disclosed height adjustment assembly comprises: a connecting member rotatably connected with a vertical portion of a piece of furniture; and a controlling plate connected with the connecting member so that the controlling plate is allowed to swing between a first position and a second position against the connecting member, the controlling plate having: at least one coupling portion, partially contacting a movable member of the furniture; at least a retaining portion, when the controlling plate is at the first position, piercing into a hole formed on the movable member; and at least an operating portion, for a user to hold and pull the controlling plate to the second position from the first position.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawing, wherein.

DETAILED DESCRIPTION OF THE PREFERRED EMBODIMENT

While a preferred embodiment provided hereinafter for illustrating the concept of the present invention as described above, it is to be understood that the components of the embodiment shown in the accompanying drawings are depicted for the sake of easy explanation and need not to be made in scale.

Figure 1:
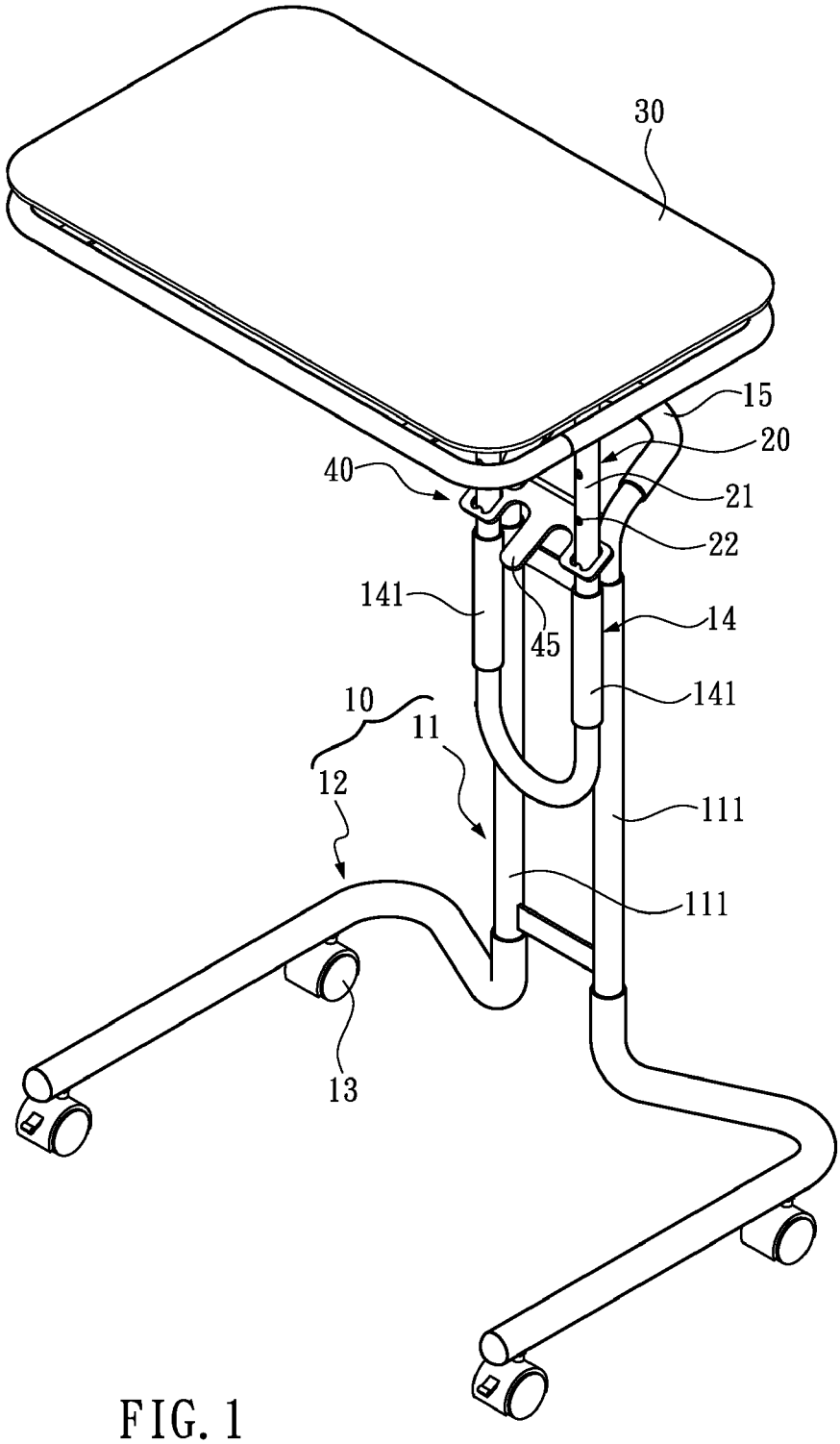
FIG. 1 is a perspective view of a table equipped with a height adjustment assembly of the present invention, wherein a tabletop plate of the table is held at a first height by the height adjustment assembly.

Referring to FIG. 1 for an exemplificative piece of furniture where a height adjustment assembly of the present invention is adapted. The furniture is herein a table includes a brace 10 that has a vertical portion 11. A movable member 20 is such attached to the vertical portion 11 that the movable member 20 can vertically move with respect to the vertical portion 11. In the present embodiment shown in the drawings, the movable member 20 is fixed atop with a tabletop plate 30. A height adjustment assembly 40 of the present invention is assembled to the brace 10 and corresponding to the movable member 20 for a user to operate. The height adjustment assembly 40 normally at a first position can be posed to a second position by the user's operation. The height adjustment assembly 40, at the first position, serves to fix and retain the movable member 20 from moving vertically. The height adjustment assembly 40, at the second position, releases the movable member 20 so as to allow the movable member 20 to move vertically, thereby changing a height of the tabletop plate 30.

The brace 10 includes a horizontal base 12 that has one end coupled with a lower end of the vertical portion 11. The vertical portion 11 is constructed from two parallel stems 111. Besides, a plurality of universal wheels 13 for facilitating movement of the brace 10. A fixing member 14 is provided on the vertical portion 11 for receiving a part of the movable member 20. A handle car 15 is mounted top the vertical portion 11 and extending away from the fixing member 14. According to the drawings, the movable member 20 includes two parallel rods 21 while the fixing member 14 includes two tubes 141, wherein each said rod 21 is fittingly received by a respective said tube 141 so that the rods are stably located in the tube 141 without swing.

Figure 2:
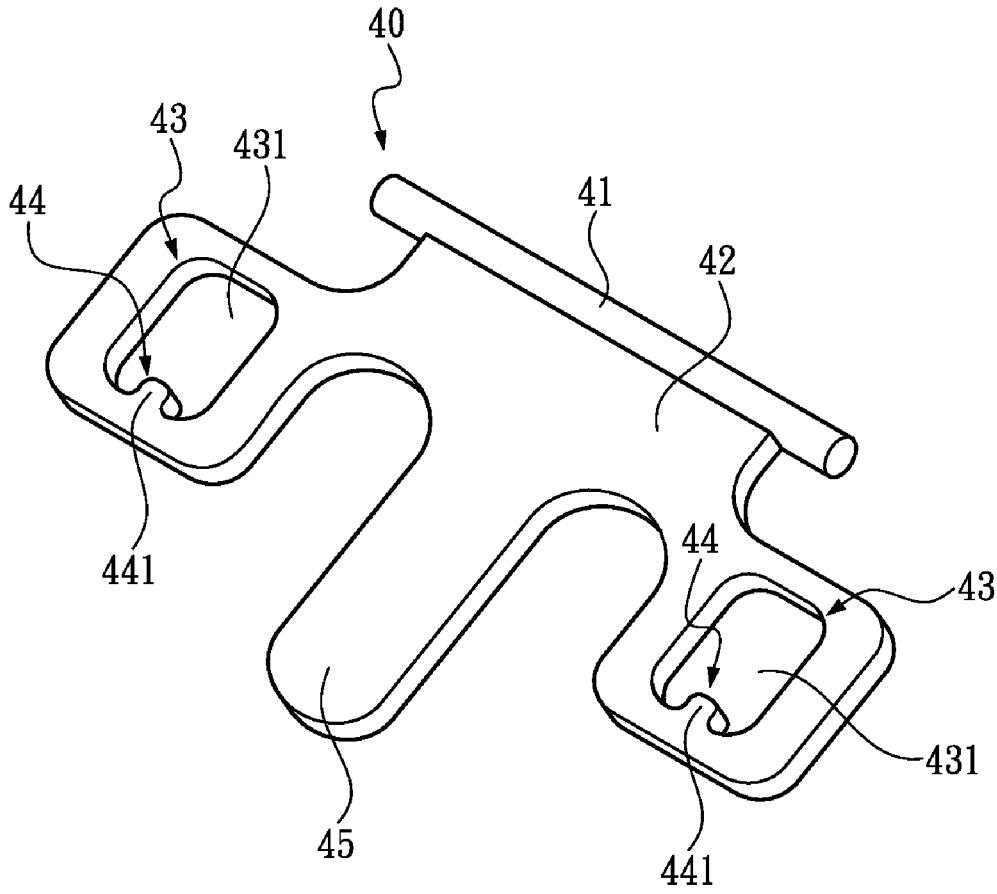
FIG. 2 is a perspective view of the height adjustment assembly of the present invention.
Figure 3:
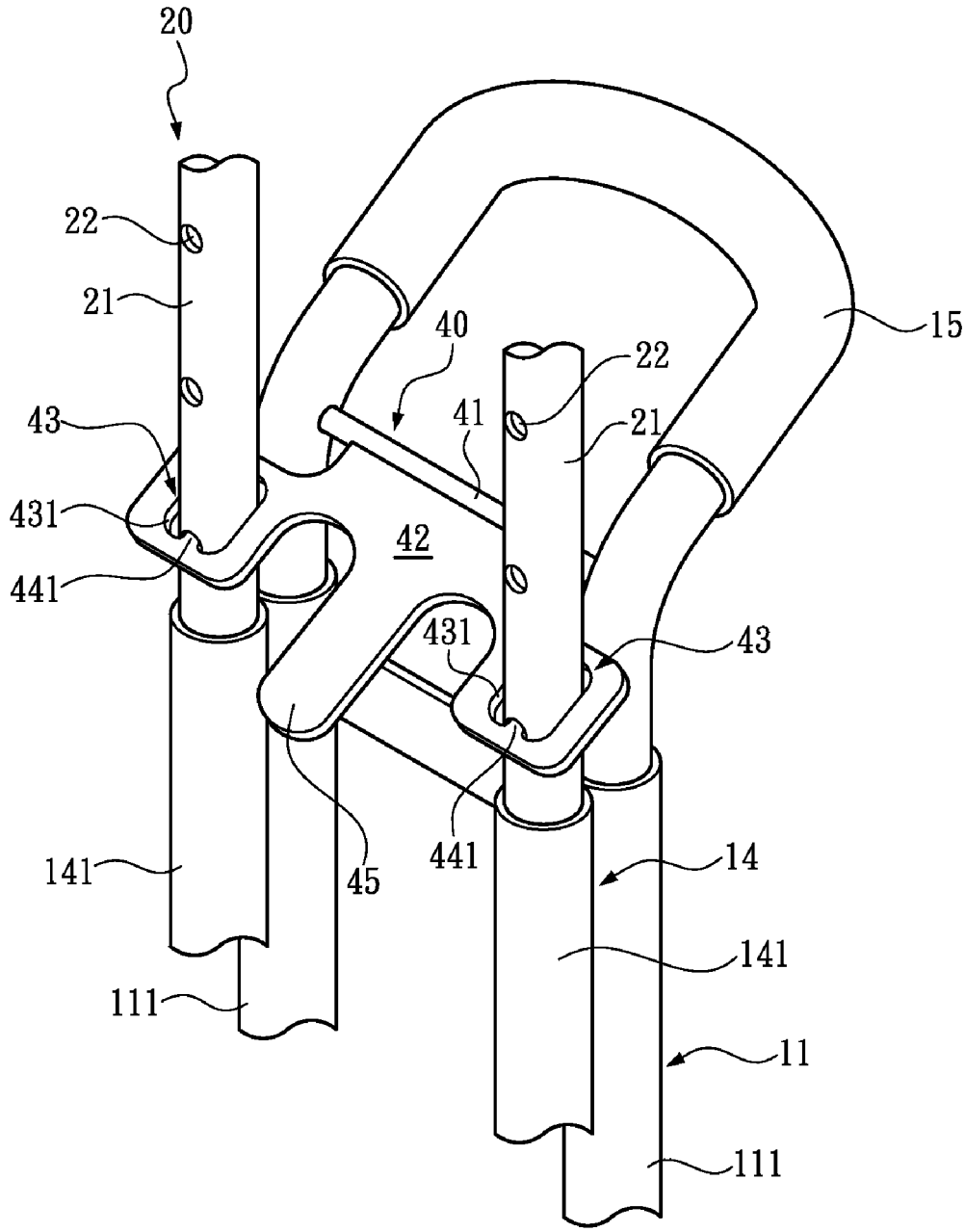
FIG. 3 is a partial perspective view of the table of FIG. 1, wherein a movable member of the table is fastened.

Referring to FIGS. 2 and 3, the height adjustment assembly 40 primarily comprises a connecting member 41 and a controlling plate 42.

The connecting member 41 is rotatably connected with the vertical portion 11. In the present embodiment, the connecting member 41 is a shaft with two ends thereof pivotably coupled with the two stems 111.

The controlling plate 42 is connected with the connecting member 41 in a bias manner. The controlling plate 42 has a coupling portion 43 fitting a part of the movable member 20, a retaining portion 44 for engaging with the movable member 20, and an operating portion 45 for a user to operate. Since the connecting member 41 is rotatably coupled with the vertical portion 111, the controlling plate 42 is allowed to swing against the connecting member 41. According to the present embodiment, the coupling portion 43 is a pair of through holes 431 formed on the controlling plate 42. Each said through hole 431 has an inner diameter greater than a diameter of a corresponding said rod 21 of the movable member 20. Moreover, a plurality of holes 22 is aligned vertically as a line on each said rod 21 of the movable member 20 while the retaining portion 44 is a pin 441 formed at a periphery of each of the through holes 431. Stating differently, the pin 441 is configured for being inserted into any of the holes 22.

Figure 5:
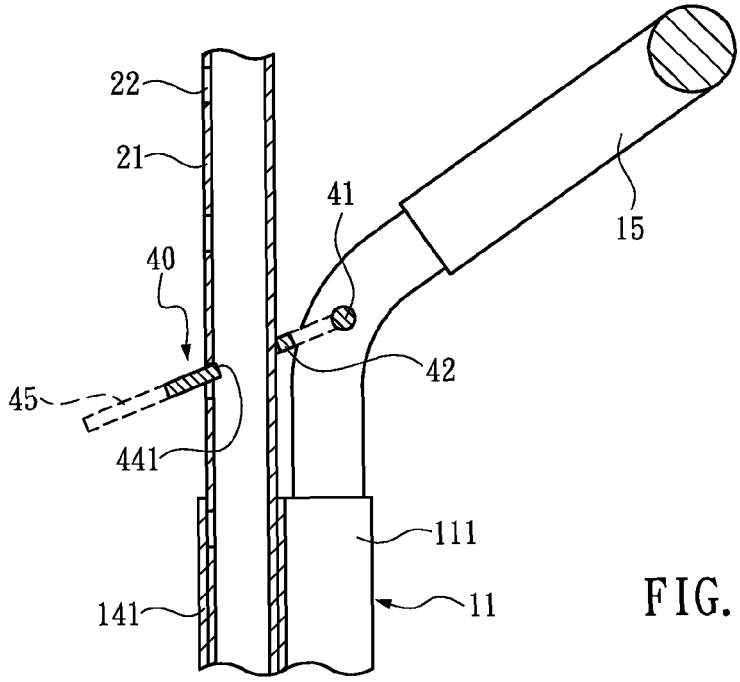
FIG. 5 is a schematic drawing showing the movable member is retained by the height adjustment assembly.

As can be seen in FIGS. 3 and 5, since the controlling plate 42 is connected with the connecting member 41 in said bias manner, the height adjustment assembly 40 is normally posed at the first position where the controlling plate 42 slant downward upon the connecting member 41. At this time, the coupling portion 43 and the rods 43 have their axes intersecting and including an angle smaller than 90 degrees. Consequently, the rods 21 and peripheries of the through holes 431 are interfered with each other. Meantime, the pins 441 are inserted to corresponding said holes 22 on the rods 21. As a result, the rods 21 are restricted from moving vertically in the tubes 141 and the height of the tabletop plate 30 is fixed.

Figure 4:
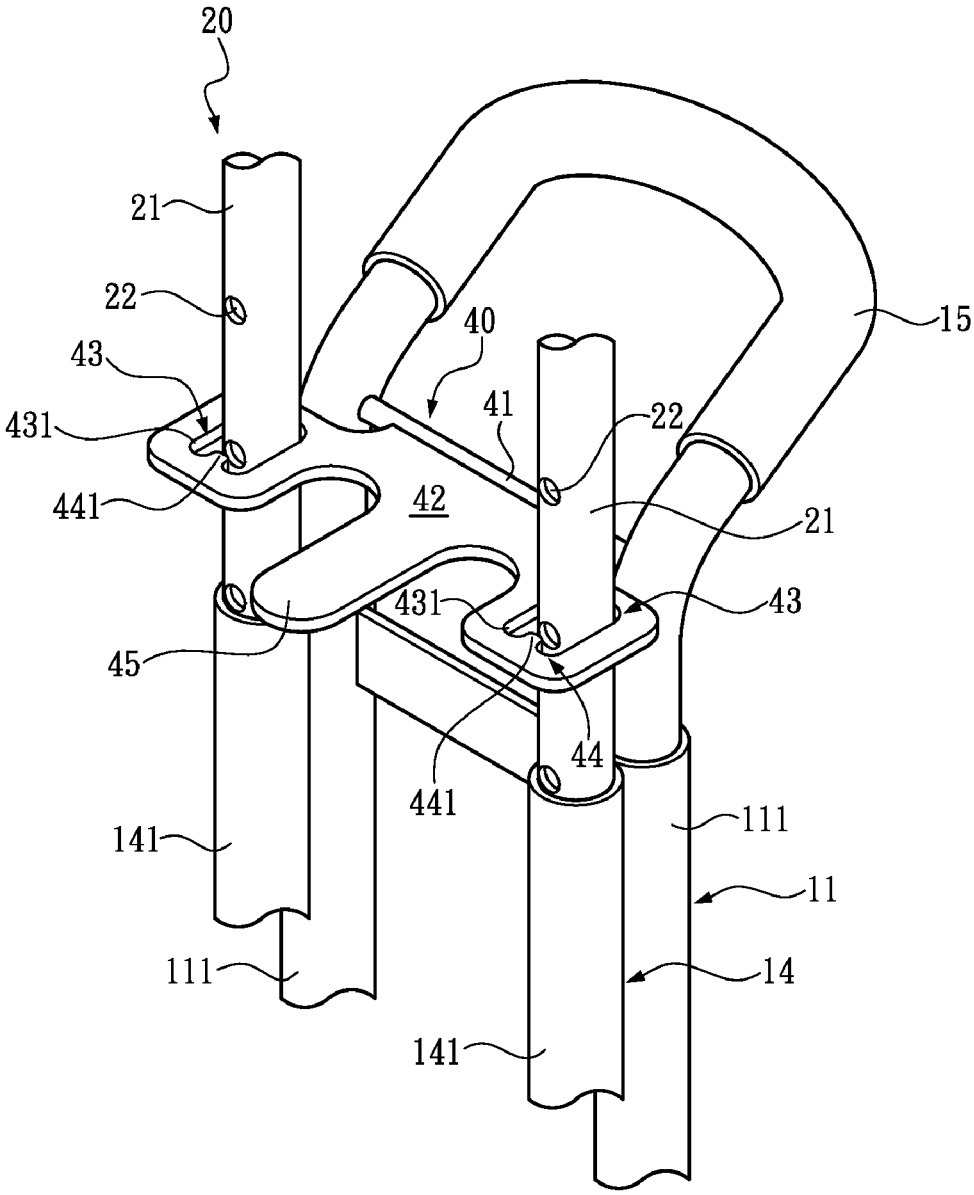
FIG. 4 is a partial perspective view of the table of FIG. 1, wherein the movable member of the table is released.
Figure 6:
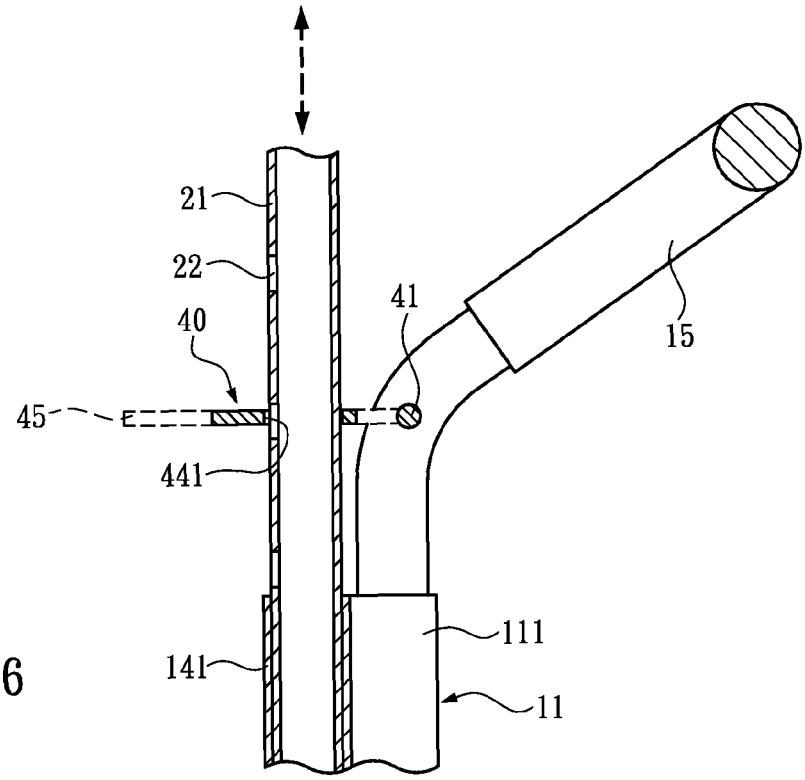
FIG. 6 is a schematic drawing showing the movable member is released from the height adjustment assembly.

Referring to FIGS. 4 and 6, to change the height of the tabletop plate 30, a user may hold the operating portion 45 to pull the controlling plate 42 upward to a horizontal position, namely the second position. At this time, the coupling portion 43 and the rods 21 have their axes intersecting and including an angle equal to 90 degrees. Consequently, interference between the rods 21 and the peripheries of the through holes 431 is relieved. Thus, the pins 441 leave the holes 22 so that the rods 21 are allowed to move vertically in the tubes 141 and through the through holes 431, thereby realizing height adjustment of the tabletop plate 30.

Figure 7:
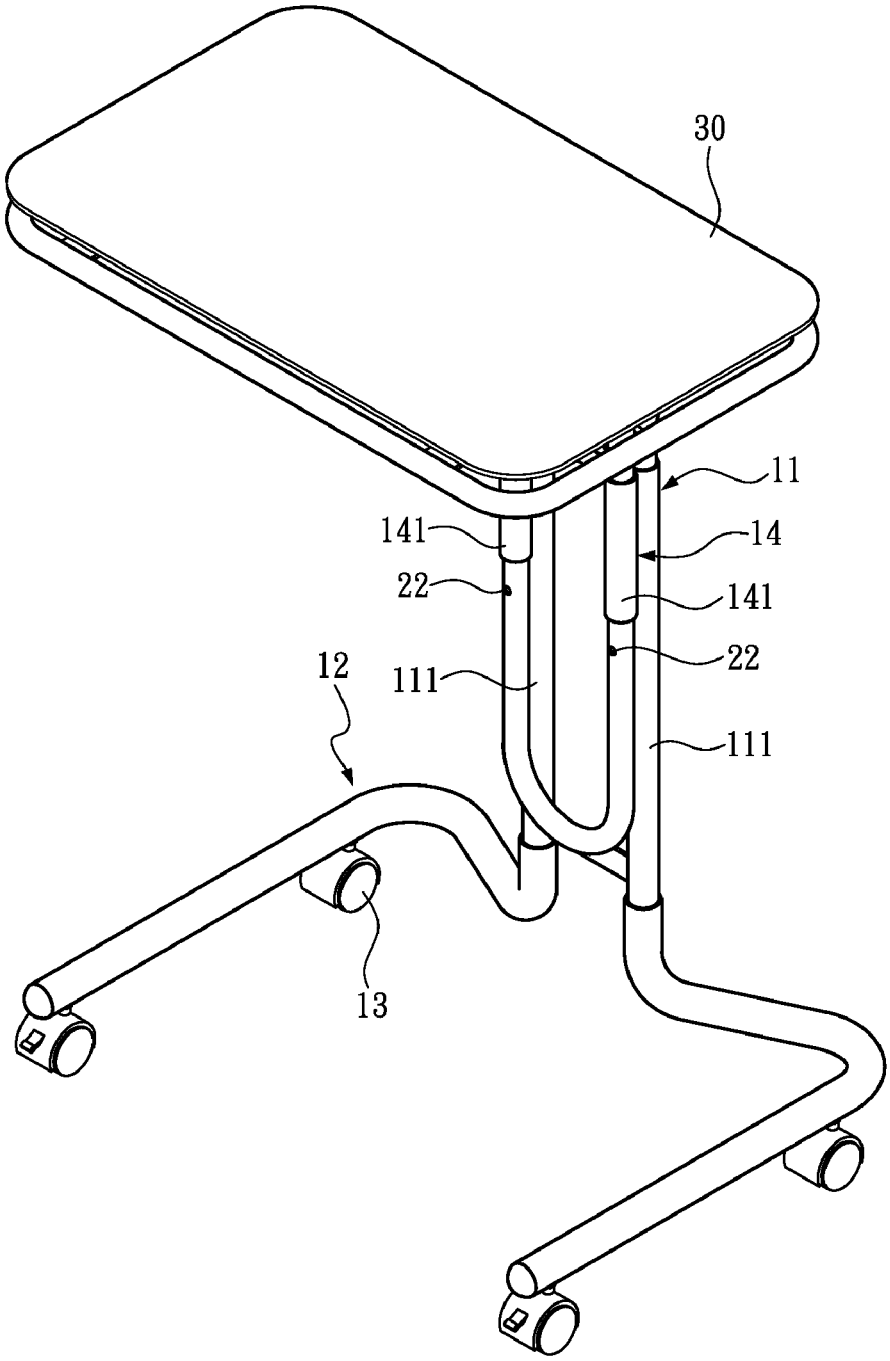
FIG. 7 is a perspective view of the table equipped with the height adjustment assembly of the present invention, wherein the tabletop plate of the table is held at a second height by the height adjustment assembly.

By comparing the perspective views of the table as shown FIG. 1 and FIG. 7, it is clear that the tabletop plate 30 is higher in FIG. 1 than in FIG. 7.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A height adjustment assembly, comprising:

a connecting member rotatably connected with a vertical portion of a piece of furniture; and a controlling plate connected with the connecting member so that the controlling plate is allowed to swing between a first position and a second position against the connecting member, the controlling plate having:

at least a coupling portion partially contacting a movable member of the furniture;

at least a retaining portion when the controlling plate is at the first position, piercing into a hole formed on the movable member of the furniture; and at least an operating portion that is operatable to make the controlling plate swing between the first position and the second position.

2. The height adjustment assembly of claim 1, wherein the coupling portion is a through hole formed on the controlling plate.

3. The height adjustment assembly of claim 2, wherein the movable member is a rod passing through the through hole.

4. The height adjustment assembly of claim 3, wherein the retaining portion is a pin formed at a periphery of the through hole.

5. The height adjustment assembly of claim 4, wherein a plurality of holes is aligned vertically on the rod and configured for the pin to be retained in any of the holes.

* * * * *